US007284280B2

(12) United States Patent
Schultz

(10) Patent No.: US 7,284,280 B2
(45) Date of Patent: Oct. 23, 2007

(54) ENERGY WEAPON PROTECTION DEVICE

(76) Inventor: Gregory Russell Schultz, 16721 W. Falcon La., Marana, AZ (US) 85653

( * ) Notice: Subject to any disclaimer, the term of this patent is extended or adjusted under 35 U.S.C. 154(b) by 0 days.

(21) Appl. No.: 11/259,161

(22) Filed: Oct. 26, 2005

(65) Prior Publication Data

US 2006/0230484 A1 Oct. 19, 2006

Related U.S. Application Data

(60) Provisional application No. 60/594,400, filed on Apr. 5, 2005.

(51) Int. Cl.

| | |
|---|---|
| ***F41H 1/00*** | (2006.01) |
| ***F41H 5/08*** | (2006.01) |
| ***A62B 17/00*** | (2006.01) |
| ***A41D 27/02*** | (2006.01) |
| *F41H 13/00* | (2006.01) |

(52) U.S. Cl. ..... 2/2.5; 2/81; 2/458; 2/97; 2/102; 2/243.1; 2/272; 2/905; 428/911; 428/902; 428/920

(58) Field of Classification Search ..... 2/2.5, 2/455, 411, 412, 46, 81, 458, 97, 102, 103, 2/243.1, 272, 902, 905, 906; 428/911, 190, 428/902, 920, 686, 931; 442/117, 229, 301, 442/377

See application file for complete search history.

(56) References Cited

U.S. PATENT DOCUMENTS 3,917,891 A * 11/1975 Cooke et al. ..... 428/337
4,487,583 A * 12/1984 Brucker et al. ..... 434/22
4,686,128 A * 8/1987 Gentilman ..... 428/44
4,943,885 A * 7/1990 Willoughby et al. ..... 361/232
5,736,474 A * 4/1998 Thomas ..... 442/388
6,272,781 B1 * 8/2001 Resnick ..... 42/1.11
2004/0264099 A1 * 12/2004 Sikes et al. ..... 361/232
2006/0175581 A1 * 8/2006 Douglas ..... 252/500
2006/0230484 A1 * 10/2006 Schultz ..... 2/2.5

* cited by examiner

*Primary Examiner*—Gary L. Welch
*Assistant Examiner*—Robert Muromoto
(74) *Attorney, Agent, or Firm*—Adam H. Jacobs

(57) ABSTRACT

An energy weapon protection device to be worn by a live potential target includes a generally flexible main panel having three main elements, a generally flexible, generally planar electrically non-conductive outer insulator panel, an electrically conductive inner conductive panel and an electrically non-conductive insulating backing panel. The inner conductive panel is mounted on the insulating back panel in generally parallel alignment and the outer insulator panel is mounted on the inner conductive panel in generally parallel alignment thereby forming the main panel, and the main panel is operative to receive an electrical pulse from an energy weapon through the outer insulator panel into the inner conductive panel which completes the electric circuit for the energy weapon and the insulating backing panel generally preventing electric current from passing therethrough from the inner conductive panel such that the live potential target is protected from the electrical pulse generated by the energy weapon.

15 Claims, 3 Drawing Sheets

ENERGY WEAPON PROTECTION DEVICE

CROSS-REFERENCE TO RELATED PROVISIONAL PATENT

This application claims priority based on a provisional patent, specifically on the Provisional Patent Application Ser. No. 60/594,400 filed Apr. 5, 2005, which provisional patent application is incorporated by reference herein.

BACKGROUND OF THE INVENTION

1. Technical Field

The present invention is directed to energy weapon protection devices and, more particularly, to an energy weapon protection device which is usable with many different types of vests and body armors, including bullet-proof vests and body armor, and which includes three separate layered panels, a non-conductive outer insulation panel, an electrically conductive inner conducting panel, and a non-conductive insulating backing panel, the three panels being mountable on top of the bullet-proof vest or body armor, the protection panel functioning to discharge energy weapons which are shot at a person wearing the device without permitting electrical transfer to the individual.

2. Description of the Prior Art

There are many different types of protection devices which are used by law enforcement agents to prevent their accidentally or intentionally being incapacitated or killed during performance of their jobs. Among these are such devices as bullet-proof vests, KEVLAR body armor, and hand-held shields which can be used to prevent the entry of ballistic projectiles into the person's body wearing the armor or using the shield. While such protective devices are well-suited for protection against penetration of projectile-type objects such as bullets and the like, such protective devices do not provide protection against energy-type weapons such as TASERS, "stun guns" or other electrical pulse-based assault devices. There is therefore a need for a protective device which may be used in conjunction with bullet-proof vests or KEVLAR-type body armor which will protect the wearer from the use of energy-type weapons.

There are two main types of energy weapons currently found in use. The first is the penetrating energy weapon of the kind commonly known as the TASER, and the second is the non-penetrating energy weapon such as the type known as the "stun gun." Briefly, the TASER includes two explosive-propelled barbs having thin electrically conducting wires extending rearwards from the barbs to the TASER unit held by the person firing the TASER. When the barbs embed in the skin of the target, a high voltage electrical charge is sent through the wires from the unit being held by the person using the TASER. The body of the target serves as a "ground" for the two wires, one of which is positive and one of which is negative, and thus the circuit is completed and the voltage is passed through the target's body incapacitating the target.

With a non-penetrating energy weapon such as a stun gun, on the other hand, spaced-apart positive and negative electrodes protrude from the body of the stun gun and, when these are brought into contact with the skin or clothing of the target, the circuit is completed between the positive and negative electrodes and the target again is electrocuted, thus incapacitating the target. While the non-penetrating energy weapon clearly can be more difficult to bring into contact with the individual, particularly if the target is uncooperative, it also can be more effective and have a greater probability of functioning correctly than a penetrating energy weapon. In either case, however, proper functioning of the TASER or stun gun will incapacitate the target. While this result is certainly acceptable when the TASER or stun gun is being used by a law enforcement officer to incapacitate a criminal in the performance of his or her duties, it is a much more serious situation when the criminal has access to the TASER or stun gun and is attempting to use it against the law enforcement officer. As many of the TASERS and stun guns currently being marketed are available to the purchasing public, this has become a very real and very dangerous probability faced by law enforcement officers. There is therefore a need for an energy weapon protection device which will substantially prevent the proper functioning of an energy weapon regardless of whether the energy weapon is a penetrating or non-penetrating energy weapon type.

Finally, it should be noted that the energy weapons currently available all incorporate electrical discharges with high voltage values but low amperage values. This is to ensure that the target will be incapacitated but will not be killed by the use of the energy weapon. This also means, however, that the discharge is more likely to follow the path of least electrical resistance, (i.e. through a more conductive material), as the high voltage of the electrical current will drive the current towards that path. Therefore, if a device were designed to offer an alternative current flow route for the energy weapon, it is conceivable that the current could be redirected away from the intended target.

Therefore, an object of the present invention is to provide an energy weapon protection device for use with garments of both protective and standard type.

Another object of the present invention is to provide an energy weapon protection device which includes an outer insulating panel, an inner conducting panel and a backing insulation panel which prevents penetration of penetrating energy weapon devices through the entire energy weapon protection device.

Another object of the present invention is to provide an energy weapon protection device which will force the energy weapon to harmlessly discharge through the conductive layer between the insulation and backing layers, thus preventing the energy weapon from incapacitating the target and rendering the energy weapon ineffective.

Another object of the present invention is to provide an energy weapon protection device which may be quickly and easily added to already-existing ballistic weapon protection devices such as bullet-proof vests and body armor.

Finally, an object of the present invention is to provide an energy weapon protection device which is relatively simple and inexpensive to manufacture and install and is safe, efficient, and effective in use.

SUMMARY OF THE INVENTION

The present invention provides an energy weapon protection device to be worn by a live potential target which includes a generally flexible main panel having three main elements. The first element is a generally flexible, generally planar electrically non-conductive outer insulator panel, the second main element is a generally flexible, generally planar electrically conductive inner conductive panel and the third main element is a generally flexible, generally planar electrically non-conductive insulating backing panel. The inner conductive panel is mounted on the insulating back panel in generally parallel alignment and the outer insulator panel is mounted on the inner conductive panel in generally parallel alignment thereby forming the main panel, and the main panel is operative to receive an electrical pulse from an energy weapon through the outer insulator panel into the inner conductive panel with the inner conductive panel completing the electric circuit for the energy weapon and the insulating backing panel generally preventing electric current from passing therethrough from the inner conductive panel such that the live potential target is protected from the electrical pulse generated by the energy weapon.

The energy weapon protection device as thus described provides numerous improvements over many protection devices found in the prior art. For example, the energy weapon protection device is extremely light weight, very flexible, and may be quickly and easily added to many different types of ballistic weapon protection garments such as bullet-proof vests and body armors. Furthermore, the energy weapon protection device of the present invention is effective for use against both penetrating and non-penetrating energy weapons, and thus the user of the present invention may not be as concerned with the specific nature of the energy weapon he or she is facing, as they can be confident that either type of energy weapon will be negated by use of the present invention. Finally, because the energy weapon protection device of the present invention generally does not permit the electrode contacts of the energy weapon to get close to the skin of the target, the present invention prevents even collateral damage to the wearer, which can be invaluable in permitting a law enforcement officer to continue his or her job even when attacked. It is therefore seen that the present invention provides a substantial improvement over those devices found in the prior art.

DESCRIPTION OF THE PREFERRED EMBODIMENT

Figure 1:
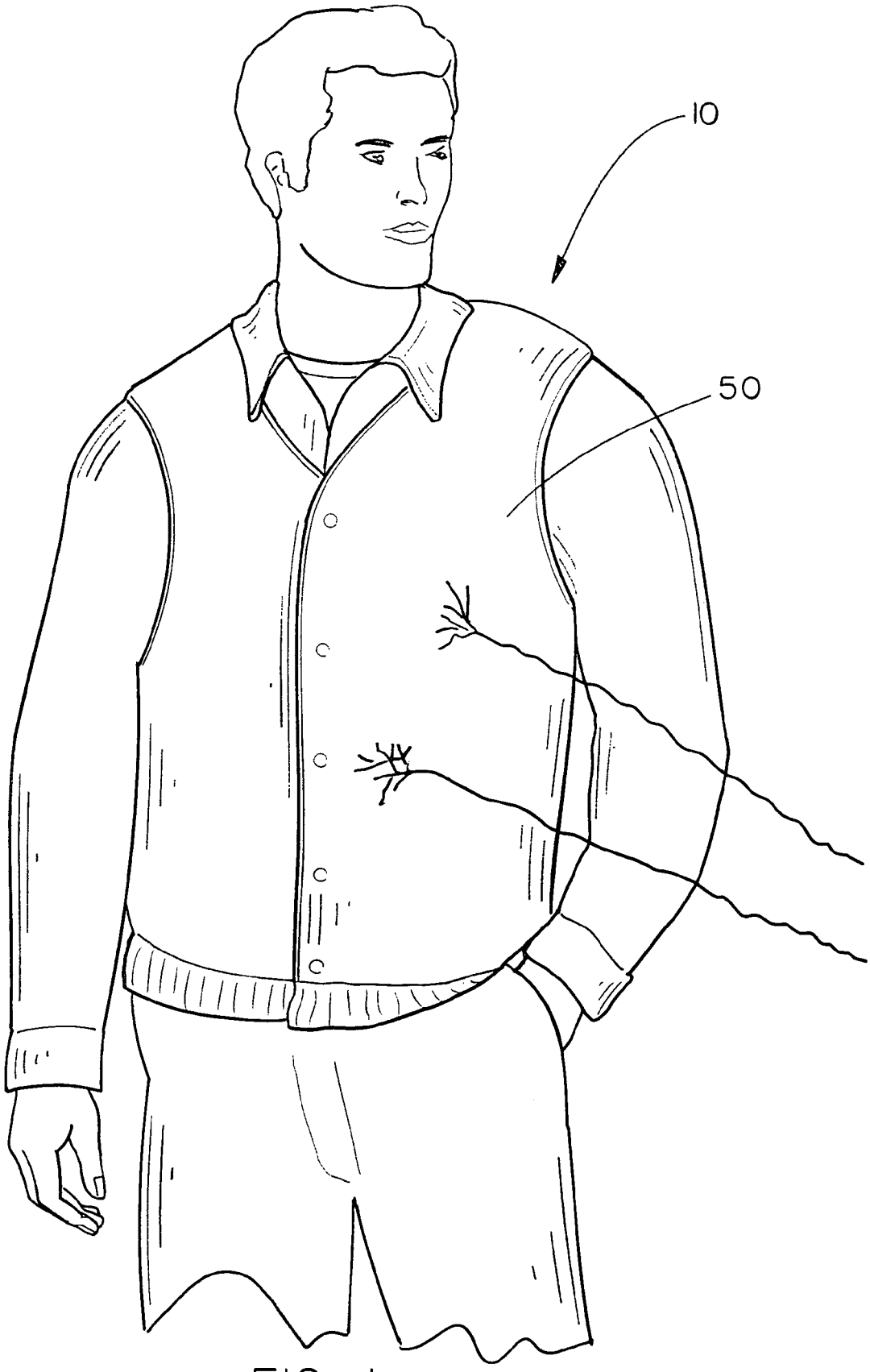
FIG. 1 is a perspective view of the energy weapon protection device of the present invention sewn into a garment and providing protection against an energy weapon for the wearer of the garment.

The energy weapon protection device 10 of the present invention is shown best in FIGS. 1–4 as including a three-ply main panel 12 which includes three separate material panels bonded together to form the main panel 12. The outermost panel is a non-conductive outer insulator panel 14, the middle panel is a highly electrically conductive inner conductive panel 20, and the third panel is the innermost non-conductive insulating backing material panel 30 which provides the foundation for the energy weapon protection device 10, as it is to the insulating backing panel 30 that the inner conducting panel 20 and outer insulating panel 14 are mounted. In the preferred embodiment, the outer insulating panel 14 would be constructed of a lightweight fabric material having non-conductive electrical properties and yet which would need to have a high heat tolerance due to the proximity of the electrically conductive material. Examples of appropriate fabrics would include man-made fabrics such as nylon and polyester which have been treated to increase their heat resistance or naturally-occurring fabric materials such as cotton which likewise have been treated to increase their heat resistance. The exact nature of the construction material is not critical, however, so long as the insulative and heat-resistant properties of the material are maintained. The outer insulating panel 14 may also be of varying thickness, although it is expected that a standard shirt fabric thickness of approximately one-sixteenth of an inch will be sufficient to provide the insulative and heat-resistant properties necessary for proper functioning of the outer insulating panel 14.

The electrically conductive inner conducting panel 20 would preferably be constructed of a fabric-like material such as a nylon or plastic man-made fabric which is threaded through with electrically conductive strands of material such as copper or steel, although it is believed that the conductive properties of copper and the ability of copper to transmit electricity without generating large amounts of heat are properties which will be beneficial when copper is used in connection with the present invention. Of course, numerous other types of designs may be incorporated into the electrically conductive inner conducting panel 20 of the present invention, and the use of various substances would be understood by one skilled in the art of preparation of conductive panel materials.

The non-conductive insulating backing panel 30 would preferably be constructed as a comparatively thick panel of fabric material such as KEVLAR or another such non-conductive insulating material which will provide not only a sturdy and flexible foundation for connection of the inner conducting panel 20 and outer insulating panel 14 thereto, but will also provide a stopping material which will prevent the penetration of penetrating energy weapons therethrough, so that the barbs of the penetrating weapon will become lodged in the insulating backing panel 30 as will be described later in this disclosure. Two important considerations when choosing the construction material for the non-conductive insulating backing panel 30 are that the insulating backing panel 30 preferably will prevent penetration of penetrating energy weapons through the insulating backing panel 30 and further that the insulating backing panel 30 provide a very high degree of electric charge insulation from current which will be traveling through the inner conducting panel 20 as the energy weapon protection device 10 of the present invention is operatively discharging the energy weapon. It is expected that additional experimentation with various types of construction materials to be used in connection with the non-conductive insulating backing panel 30 will provide a definitive answer as to which material is best suited for use in the construction of the non-conductive insulating backing panel 30, but, at the present time, it is believed that use of such construction materials as KEVLAR or other such materials will provide sufficient stopping and insulating power for the present invention.

Figure 4:
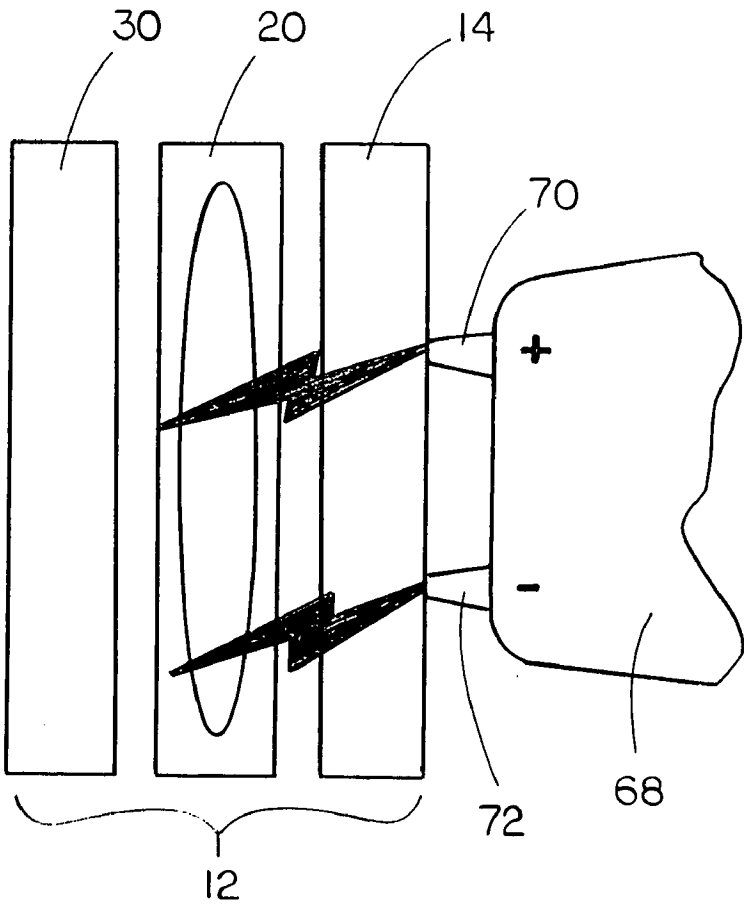
FIGS. 3 and 4 are diagrammatical views of the present invention acting to discharge penetrating and non-penetrating energy weapons respectively.
Figure 3:
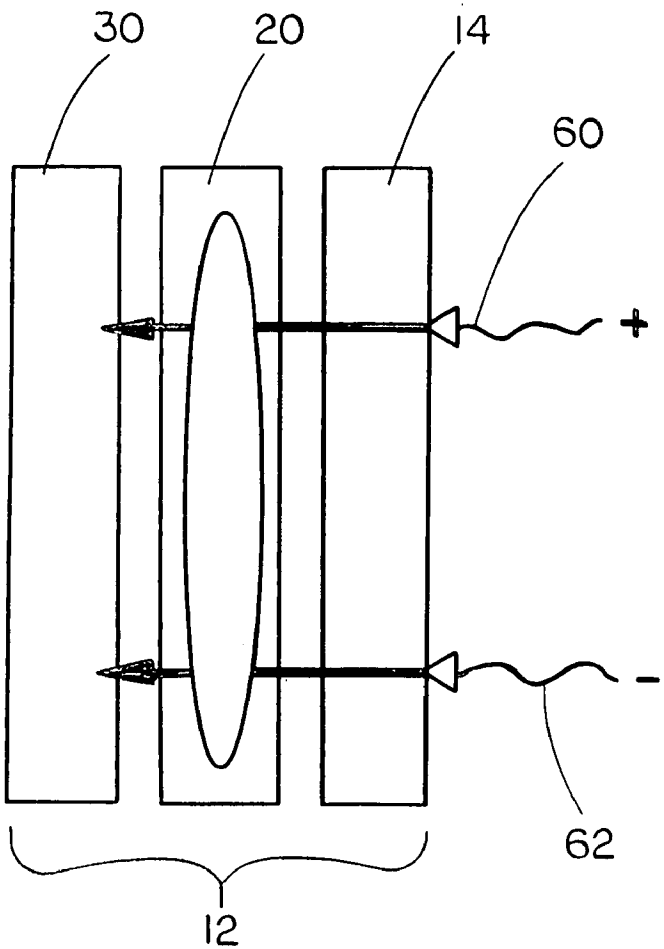

The non-conductive outer insulating panel 14, conductive inner conductive panel 20, and non-conductive insulating backing panel 30 are then bonded and connected to one another in a parallel planar configuration to form the main panel 12, as shown in FIGS. 3 and 4. It is expected that the connection of the panels would be via adhesive or by sewing the panels to one another, although the precise method and materials used to connect the panels is not particularly critical to the present invention so long as the three panels remain in parallel planar orientation regardless of use and operation. Furthermore, it is expected that the main panel 12, once constructed, would have a flexibility similar to the flexibility of a denim fabric panel, so that the main panel 12 may be comfortably worn in connection with many different types of garments.

The energy weapon protection device 10 of the present invention is thus constructed and is ready for use in connection with various types of garments and already-existing ballistic weapon protection devices. An example of the use of the energy weapon protection device 10 of the present invention is shown best in FIGS. 1 and 2 as being incorporated into a sweater vest 50 or the like which would have the energy weapon protection device 10 of the present invention affixed to the inner side of the sweater vest 50, as shown best in FIG. 2. The energy weapon protection device 10 would then function to protect the wearer of the device by efficiently returning electricity delivered by an energy weapon back to the weapon without allowing any of the electricity to penetrate and pass through the body of the target wearing the energy weapon protection device 10.

Specifically, when a penetrating energy weapon of the TASER type is used against a person wearing the energy weapon protection device 10 of the present invention, as shown in FIG. 3, the positive lead 60 and negative lead 62 of the penetrating energy weapon would attempt to extend into the body of the individual wearing the energy weapon protection device 10. The positive and negative leads 60 and 62 pass through the non-conductive outer insulating panel 14 and through the conductive inner conductive panel 20, but then are stopped in the non-conductive insulating backing panel 30 and thus are prevented from entering the body of the individual wearing the energy weapon protection device 10. When the energy pulse from the penetrating energy weapon is delivered, the electric charge flows down the positive lead 60 and, instead of passing through the body of the individual wearing the energy weapon protection device 10, the charge instead passes through the conductive inner conducting panel 20 and into negative lead 62, thus completing the circuit between the positive and negative leads 60 and 62 of the penetrating energy weapon. The individual wearing the energy weapon protection device 10 is thus safe from the electrical charge sent from the penetrating energy weapon and therefore the penetrating energy weapon is rendered ineffective.

In a similar manner, a non-penetrating energy weapon, when used against the energy weapon protection device 10 of the present invention, is also rendered ineffective. Specifically, as shown in FIG. 4, when the positive electrode 70 and negative electrode 72 of the non-penetrating energy weapon 68 contact the energy weapon protection device 10, the charge delivered by the non-penetrating energy weapon will break down the non-conductive outer insulating panel 14, thus permitting the positive electrode 70 and negative electrode 72 to contact the conductive inner conducting panel 20. As was described previously in connection with the penetrating energy weapon of FIG. 3, the energy pulse delivered by the non-penetrating energy weapon 68 passes through positive electrode 70 into the conductive inner conducting panel 20 and to the negative electrode 72, thus bypassing penetration of the skin and body of the wearer of the energy weapon protection device 10 of the present invention and substantially preventing the proper functioning of the non-penetrating energy weapon 68, thus rendering it ineffective. In both instances, the non-conductive insulating backing panel 30 ensures that the wearer of the present invention is generally unaffected by the energy weapon, be it penetrating or non-penetrating.

An alternative embodiment of the present invention would include a non-conductive insulating backing panel 30 which would preferably have a thickness approximately equal to the thickness of the non-conductive outer insulating panel 14 so that the entire main panel 12 would have preferably have a thickness of less than ⅓" and certainly less than ½". The main panel 12 is thus not only exceedingly light in weight but also is very flexible and thus can be incorporated into a wide variety of garments.

For example, the main panel 12 could be sewn onto the inner wall of a T-shirt, sweatshirt or other such light garment, and the energy weapon disabling properties of the present invention would then be available to the wearer of the modified garment. Moreover, because of the extremely light weight of the main panel 12, the garment is not made significantly heavier and thus is wearable in the same manner as it was worn prior to modification. It is also contemplated to include the alternative embodiment of the main panel 12 in many other types of garments and accessories, including riot gloves, hats, body armor, bullet-proof vests and many other protective garments which are used for body part protection. While this variation of the invention does not offer the same opposition to the penetration of the barbs of a penetrating energy weapon, it does offer the same prevention of electrical charge transfer. In fact, it has been found that with penetration energy weapons, even when the barbs enter the skin through the main panel 12, the resistance of the human body to the passage of electricity exceeds the resistance of the conductive inner conducting panel 20, and therefore the current passes through the conductive inner conducting panel 20 and not through the barbs of the penetration energy weapon. The main panel 12 thus protects the wearer from the current emitted by the energy weapon, and therefore renders the weapon ineffective.

Figure 2:
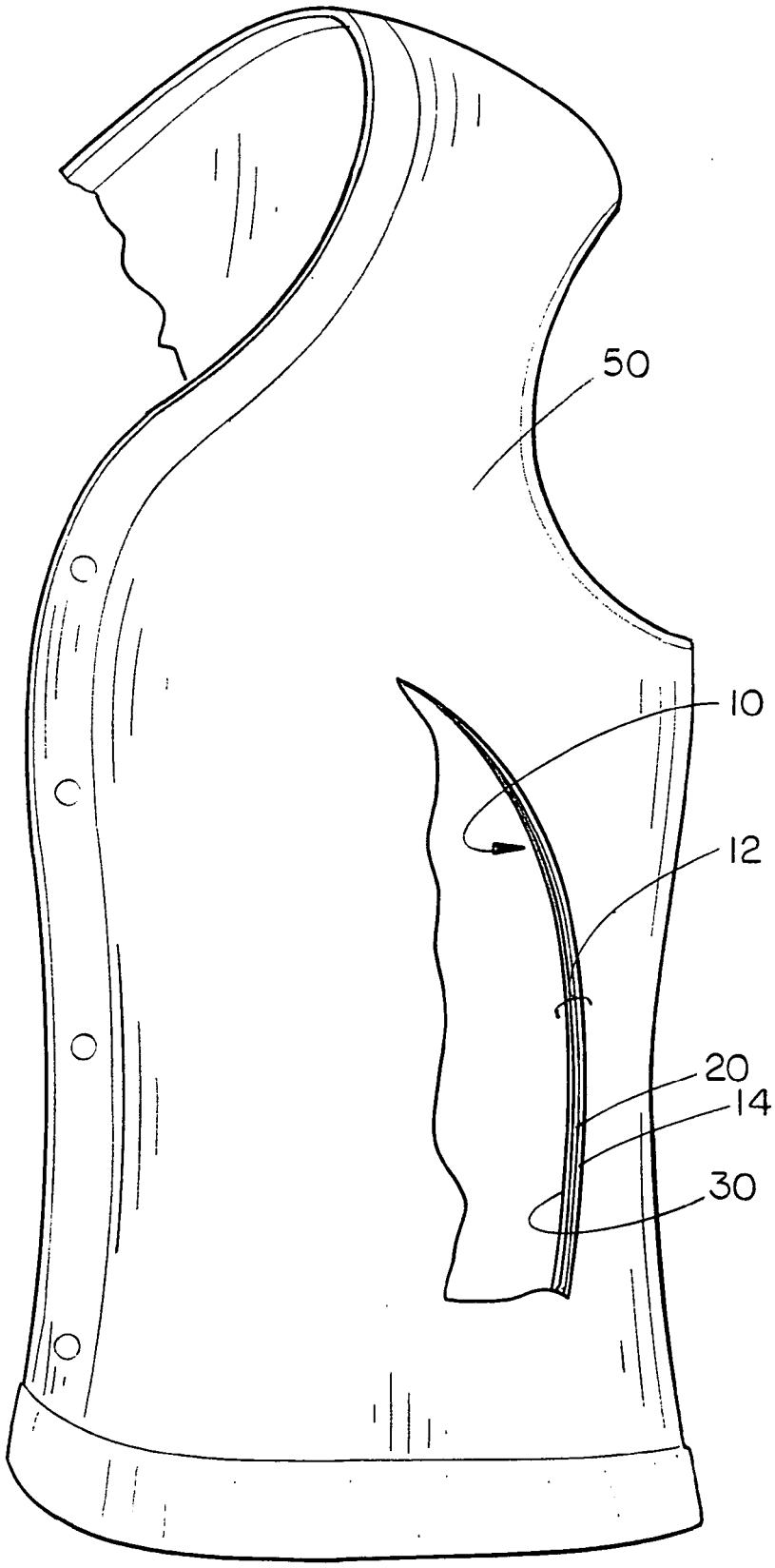
FIG. 2 is a detailed perspective cutaway view of the present invention showing how the present invention is sewn into the garment for use therewith.

It is to be understood that numerous additions, modifications and substitutions may be made to the energy weapon protection device 10 of the present invention which fall within the intended broad scope of the appended claims. For example, the precise size, shape, and construction materials used in connection with the main panel 12 and specifically the three individual panels of the present invention may be modified or changed so long as the functional features of those panels are generally maintained. Furthermore, although the present invention, as shown in FIGS. 1 and 2, is being used in connection with a standard upper body garment, specifically a sweater vest 50, it is fully expected that the present invention will be used in connection with ballistic weapon protective devices such as bullet-proof vests and body armor, being affixed to the outer surface thereof, and it is in connection with these devices that the present invention will likely prove highly effective. Finally, depending on the exact design of the present invention, penetrating energy weapons may only penetrate the first two layers of the present invention, thus causing discharge of the energy weapon through the inner conducting panel 20 without contacting the insulating backing panel 30, and such variations in operation and effectiveness of the present invention should be understood to be a part of this disclosure.

There has therefore been shown and described an energy weapon protection device 10 which accomplishes at least all of its intended objectives.

I claim:

1. An energy weapon protection device to be worn by a live potential target comprising:

a generally flexible main panel including;

a generally flexible, generally planar electrically non-conductive outer insulator panel;

a generally flexible, generally planar electrically conductive inner conductive panel means for permitting penetration of a penetrating energy weapon therethrough;

a generally flexible, generally planar electrically non-conductive penetration-resistant insulating backing panel;

said inner conductive panel mounted on said insulating backing panel in generally parallel alignment and said outer insulator panel mounted on said inner conductive panel means in generally parallel alignment thereby forming said main panel;

said main panel receiving an electrical pulse from an energy weapon through said outer insulator panel into said inner conductive panel means with said inner conductive panel means completing the electric circuit for the energy weapon and said insulating backing panel preventing complete penetration of penetrating energy weapons therethrough and generally preventing electric current from passing therethrough from said inner conductive panel means such that the live potential target is protected from the electrical pulse generated by the energy weapon.

2. The energy weapon protection device of claim 1 wherein said generally flexible, generally planar electrically non-conductive outer insulator panel is constructed of a lightweight flexible fabric material having non-conductive electrical properties and a substantial heat tolerance.

3. The energy weapon protection device of claim 1 wherein said generally flexible, generally planar electrically conductive inner conductive panel is constructed as including a plurality of electrically conductive strands of electrically conductive material for conducting electricity passing through said inner conductive panel.

4. The energy weapon protection device of claim 1 wherein said generally flexible, generally planar electrically non-conductive insulating backing panel is constructed of a panel of ballistic impact resistant non-conductive insulating fabric material operative to generally prevent the penetration of penetrating energy weapons therethrough and generally prevent transfer of electrical charge therethrough.

5. The energy weapon protection device of claim 1 wherein said generally flexible, generally planar electrically non-conductive insulating backing panel is constructed of a panel of non-conductive insulating fabric material having a thickness approximately equal to the thickness of said generally flexible, generally planar electrically non-conductive outer insulator panel, said insulating backing panel operative to generally prevent transfer of electrical charge therethrough.

6. The energy weapon protection device of claim 1 wherein said inner conductive panel and said insulating backing panel and said insulating backing panel and said outer insulator panel are mounted, respectively, to one another by an adhesive material in generally parallel alignment thereby forming said main panel.

7. The energy weapon protection device of claim 1 wherein said inner conductive panel and said insulating backing panel and said insulating backing panel and said outer insulator panel are mounted, respectively, to one another by stitches in generally parallel alignment thereby forming said main panel.

8. In combination:

a garment having an outer surface and an inner surface, said garment adapted to be worn at least partially cover a selected body part of a potential live target; and an energy weapon protection device comprising:

a generally flexible main panel including;

a generally flexible, generally planar electrically non-conductive outer insulator panel;

a generally flexible, generally planar electrically conductive inner conductive means for permitting penetration of a penetrating energy weapon therethrough;

a generally flexible, generally planar electrically non-conductive insulating penetration resistant backing panel;

said inner conductive panel means mounted on said insulating backing panel in generally parallel alignment and said outer insulator panel mounted on said inner conductive panel means in generally parallel alignment thereby forming said main panel;

said main panel operative to receive an electrical pulse from an energy weapon through said outer insulator panel into said inner conductive panel means with said inner conductive panel means completing the electric circuit for the energy weapon and said insulating backing panel generally preventing electric current from passing therethrough from said inner conductive panel means;

said main panel mounted on said garment on at least one of said inner and outer surfaces whereby the live potential target is protected from the electrical pulse generated by the energy weapon.

9. The combination of claim 8 wherein said garment is selected from the group consisting of hats, shirts, pants, flak jackets, bullet-proof vests, body armor and gloves.

10. The combination of claim 8 wherein said generally flexible, generally planar electrically non-conductive outer insulator panel is constructed of a lightweight flexible fabric material having non-conductive electrical properties and a substantial heat tolerance.

11. The combination of claim 8 wherein said generally flexible, generally planar electrically conductive inner conductive panel is constructed as including a plurality of electrically conductive strands of electrically conductive material for conducting electricity passing through said inner conductive panel.

12. The combination of claim 8 wherein said generally flexible, generally planar electrically non-conductive insulating backing panel is constructed of a panel of ballistic impact resistant non-conductive insulating fabric material operative to generally prevent the penetration of penetrating energy weapons and generally prevent transfer of electrical charge therethrough.

13. The combination of claim 8 wherein said generally flexible, generally planar electrically non-conductive insulating backing panel is constructed of a panel of non-conductive insulating fabric material having a thickness approximately equal to the thickness of said generally flexible, generally planar electrically non-conductive outer insulator panel, said insulating backing panel operative to generally prevent transfer of electrical charge therethrough.

14. The combination of claim 8 wherein said inner conductive panel and said insulating backing panel and said insulating backing panel and said outer insulator panel are mounted, respectively, to one another by an adhesive material in generally parallel alignment thereby forming said main panel.

15. The combination of claim 8 wherein said inner conductive panel and said insulating backing panel and said insulating backing panel and said outer insulator panel are mounted, respectively, to one another by stitches in generally parallel alignment thereby forming said main panel.

* * * * *